US005977858A

United States Patent [19]

Morgen et al.

[11] Patent Number: 5,977,858

[45] Date of Patent: Nov. 2, 1999

[54] ELECTRO-THERMAL BI-STABLE ACTUATOR

[75] Inventors: Robert Morgen, Los Angeles; Harold H. Yee, Rancho Palos Verdes, both of Calif.

[73] Assignee: Hughes Electronics Corporation, Los Angeles, Calif.

[21] Appl. No.: 09/126,898

[22] Filed: Jul. 31, 1998

[51] Int. Cl.[6] ..... H01H 61/06; H01H 37/46; H01H 37/50

[52] U.S. Cl. ..... 337/140; 337/12; 337/343; 337/393; 60/527; 60/528

[58] Field of Search ..... 337/12, 140, 339, 337/141, 343, 393; 439/161, 267, 325, 630, 932; 148/402, 563; 60/527, 528; 343/593, 594

[56] References Cited

U.S. PATENT DOCUMENTS

| | | | |
|---|---|---|---|
| 3,613,732 | 10/1971 | Willson | 137/625.44 |
| 3,768,057 | 10/1973 | Sekira et al. | 337/349 |
| 3,846,679 | 11/1974 | Jost et al. | 317/132 |
| 4,544,988 | 10/1985 | Hochstein | 361/211 |
| 4,806,815 | 2/1989 | Honma | 310/307 |
| 5,061,914 | 10/1991 | Busch et al. | 337/140 |
| 5,463,514 | 10/1995 | Yaeger | 360/105 |
| 5,618,269 | 4/1997 | Jacobsen et al. | 604/118 |

*Primary Examiner*—Leo P. Picard
*Assistant Examiner*—Anatoly Vortman
*Attorney, Agent, or Firm*—Terje Gudmestad; Georgann Grunebach; Michael W. Sales

[57] ABSTRACT

An actuator that uses electrothermal energy to switch between a first latching position and a second latching position. The actuator contains a leaf spring capable of latching into two distinct positions and two shape-memory wires. The shape-memory wires contract when heated and direct the leaf spring toward the two latching states. Once positioned in a latching state, the leaf spring will remain latched in that position until directed toward a different latching state by one of the shape-memory wires.

10 Claims, 3 Drawing Sheets

ELECTRO-THERMAL BI-STABLE ACTUATOR

BACKGROUND OF THE INVENTION (a). Technical Field of the Invention

The present invention relates generally to actuator technology. More particularly, it relates to an apparatus and method for latching an actuator using thermally reactive shape-memory wires.

(b). Description of Related Art

Current actuators are based primarily on electromagnetics. These actuators convert electrical energy into magnetic energy which is then converted into mechanical energy. The most common types of these actuators are the rocker, the latching solenoid, and the rotary magnet.

In the rocker and the latching solenoids, electric current is passed through a wire coil at one end of an actuator to create a magnetic field. The magnetic field pulls a soft iron rocker (or armature) towards the wire coil. Once in position at the end of the actuator, the soft iron rocker serves as an electrical connection between two terminals. A permanent magnet near the wire coil at the end of the actuator secures the soft iron rocker in position even when the electric current is removed from the wire coil.

When it is desired to open the circuit between the two terminals, an electric current is passed through a second wire coil located on the opposite end of the actuator. This creates a magnetic field that overcomes the magnetic force of the permanent magnet and attracts the rocker toward the other side of the actuator. As the rocker breaks contact with the two terminals, the electrical connection between the terminals is removed. A second permanent magnet is typically used to help secure the rocker near the second wire coil. These actuators require a soft iron moving piece, one or two permanent magnets to provide latching force, two coils, and soft iron pole pieces.

The rotary magnet actuator has two permanent magnets attached to opposite ends of a rotating lever. The permanent magnets are positioned on the lever such that the polarity of one magnet is opposite of the other. A movable permanent magnet is positioned below the rotating lever and provides the mechanical actuating force for the circuit. When it is desired to actuate the circuit, the lever is rotated to bring one of the permanent magnets near the movable magnet. Depending on the polarity of the closest permanent magnet, the movable magnet will either be attracted or repelled. This magnetic force will drive the movable magnet to one end of the rotating actuator. To move the magnet to the other end of the actuator, the lever is rotated to bring the opposite permanent magnet near the movable magnet. This type of actuator requires a moving magnet, a lever, permanent magnets for the disk, and an actuating device to provide rotary motion to the level, which is typically an electromagnetic actuator consisting of a magnet, coils, bearings, and soft iron laminations.

The above-described actuators are relatively bulky, complex, and require a relatively large number of components. Accordingly, these actuators are not well suited for use where space and weight is at a premium, such as spaceships and satellites. There is, therefore, a need for an actuator that is small and light weight, and, therefore, useful in applications such as spaceships and satellites.

SUMMARY OF THE INVENTION

The present invention generates mechanical actuating force through the use of shape-memory wires that contract when heated instead of using electromagnetic circuits common to other actuators. The force generated by the contracting wires is sufficient to toggle a leaf spring located within the actuator between two distinct positions. The leaf spring is capable of maintaining either of the two positions with no power applied. By using shape-memory wires with a leaf spring in a lightweight frame, the invention eliminates the need for electromagnetic circuit parts such as magnets, pole pieces, and coil windings and allows the actuator to be used in applications where weight is at a premium.

One embodiment of the invention comprises a housing, a leaf spring, and two shape-memory wires. The leaf spring has a first end mounted to one point of the housing and the second end mounted to a second point of the housing. The shape-memory wires are thermally reactive and will contract when heated. The first wire directs the leaf spring into a first latching position when it contracts, and the second wire directs the leaf spring into a second latching position when it contracts. The leaf spring may further be designed such that it will remain latched in the first latching position until the second wire contracts, and will remain in the second latching position until the first wire contracts. The electrical resistance of the wires may be set sufficiently high such that the wires may be heated by simply passing an electric current through the wires.

In another embodiment, a plunger is connected to the above-described leaf spring. The plunger presses against a cantilever arm when the leaf spring is raised, forcing the cantilever arm into electrical contact with a terminal. When the leaf spring is lowered, the plunger ceases pressing against the cantilever arm and the electrical connection between the cantilever arm and the terminal is broken.

In still another embodiment, the leaf spring or a portion of the leaf spring is electrically conductive. When the leaf spring is raised, it contacts and electrically connects two terminals. When the leaf spring is lowered, the electrical connection between the two terminals is removed.

The present invention may also be embodied in a method of actuating a leaf spring comprising the steps of heating a first thermally sensitive wire such that the force of the contracting wire forces a leaf spring into a first latching position, and the step of heating a second thermally sensitive wire such that the force generate by the second thermally sensitive wire forces the leaf spring into a second latching position. The invention may further comprise the step of latching the leaf spring into the first latching position until the second wire contracts, and latching the leaf spring into the second latching position until the first wire contracts. The invention may also comprise the step of heating the wires by passing an electric current through them.

Another embodiment of the invention comprises the further steps of raising and lowering a plunger that is connected to the leaf spring. The plunger is raised when the leaf spring is in the 'up' position and lowered when the leaf spring is in the 'down' position. Raising the plunger will cause the plunger to press a cantilever arm into electrical contact with an electrical terminal.

The invention may also be embodied in a method of electrically connecting a first terminal to a second terminal by raising a conductive leaf spring or a conductive portion of a leaf spring such that the conductive surface will make electrical contact between the first terminal and the second terminal. The electrical connection between the first terminal and the second terminal may be removed by lowering the conductive surface of the leaf spring.

BRIEF DESCRIPTION OF THE DRAWINGS

These and other features and advantages of the present invention will become more apparent when a detailed consideration of the invention is taken in conjunction with the drawings wherein.

DETAILED DESCRIPTION

Figure 1:
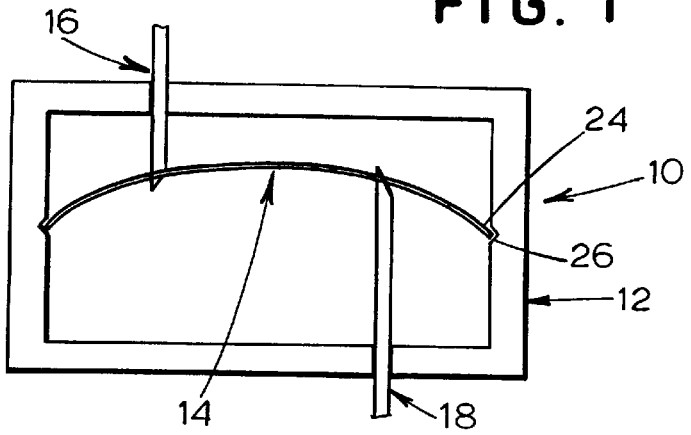
FIG. 1 illustrates an actuator embodying the present invention wherein the leaf spring of the actuator is latched in the 'up' position.
Figure 3:
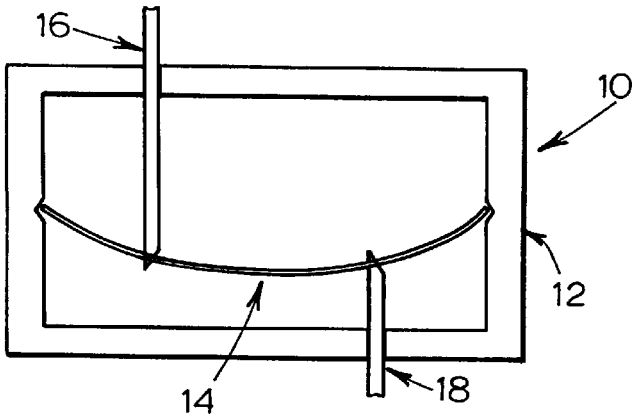
FIG. 3 shows the actuator of FIG. 1 wherein the leaf spring of the actuator is latched in the 'down' position.

FIG. 1 depicts an electro-thermal bi-stable actuator 10 embodying the present invention. The actuator 10 is constructed from a housing 12, a leaf-spring 14, a first shape-memory wire 16, and a second shape-memory wire 18. A first end 20 of the leaf spring 14 is affixed in to the housing 12 at a first connection point 22, and a second end 24 of the leaf spring 14 is connected to the housing 12 at a second connection point 26. The ends 20, 24 of the leaf spring 14 are affixed to the housing 12 such that the distance between the two connection points 22, 26 is less than the length of the leaf spring 14. This forces the leaf spring 14 into a bowed shape that is capable of resting in two different positions. FIG. 1 depicts the leaf spring 14 bowed upwards and resting in a first latching position, and FIG. 3 depicts the leaf spring 14 bowed downwards and resting in a second latching position. The leaf spring 14 remains resting in either latching position as long as an outside force does not acting upon the leaf spring 14. In the preferred embodiment, the leaf spring 14 is made out of a flexible piece of stainless steel. However, many other flexible materials may be used to construct the leaf spring 14.

The first shape-memory wire 16 and the second shape-memory wire 18 are constructed from a thermally active metal and contract when heated. The internal resistance of the wires is sufficient to allow the wires to heat up and contract simply by passing an electric current through the wires. The wires are designed from a shape-memory material that allows the wires to 'remember' their original shapes and to return to those shapes as the wires cool. This type of wire is well-known in the prior art and the invention is not limited to the use of a specific type or brand of heat sensitive shape-memory.

The first shape-memory wire 16 is positioned in the actuator such that the first wire 16 may direct the leaf spring 14 toward the first latching position. In a preferred embodiment, the first wire 16 is looped around the leaf spring 14. When the first wire 16 is heated it will contract and pull the leaf spring 14 into the first latching or 'up' position. Once the leaf spring 14 has latched in the 'up' position, the leaf spring 14 remains latched until acted upon by an outside force. When the power is removed from the first wire 16, the first wire 16 will cool and return to its normal length without disturbing the leaf spring 14 from the 'up' position.

The second shape-memory wire 18 is positioned in the actuator such that it may direct leaf spring 14 toward the second latching position. In the preferred embodiment, the second wire 18 is looped around the leaf spring 14 and is positioned such that it will pull the leaf spring 14 in the opposite direction of the first wire 16. When an electric current is passed through the second wire 18, it will contract and pull the leaf spring 14 into the second latching or 'down' position. Once the leaf spring 14 latches in the 'down' position, the power may be removed from the second wire 18 without disrupting the position of the leaf spring 14.

As stated above, the leaf spring 14 is capable of latching in either the first or the second latching positions. Once the leaf spring 14 has latched, the electric current may be removed from the shape-memory wires without dislodging the leaf spring 14. This allows the switch to hold its new position without using any additional energy, an important feature in satellite, spaceship, and other low-power applications.

Figure 2:
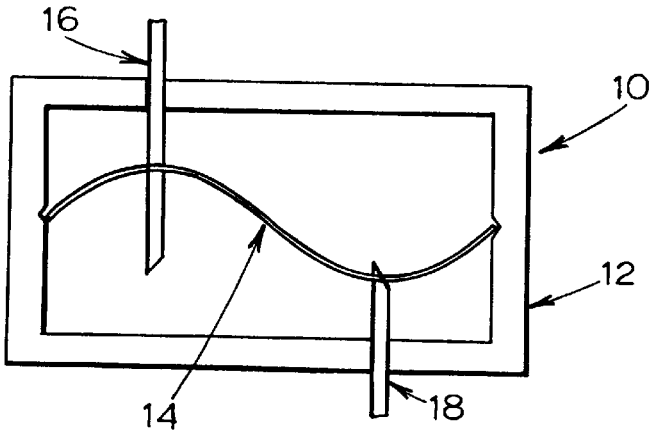
FIG. 2 shows the actuator of FIG. 1 in a transition state from the 'up' position to the 'down' position.

FIG. 2 depicts the actuator 10 of FIG. 1 in transition from the first latched position to the second latched position. In FIG. 2, the first wire 16 has cooled and returned to its uncontracted length. An electric current is applied to the second wire 18, causing the second wire 18 to contract and pull the leaf spring 14 toward the second latching position. As the second wire 18 pulls the leaf spring closer 14 and closer to the second latching position, the leaf spring 14 continues to flex until at some point the leaf spring 15 shifts completely into the second latching state, depicted in FIG. 3.

FIG. 3. depicts the actuator 10 of FIG. 1 soon after the leaf spring 14 has latched into the second latching position. The second wire 18 is still warm and has not returned to its normal length. Once the second wire 18 cools and lengthens, the first wire 16 may be heated and contracted to toggle the leaf spring 14 back into the first latching position shown in FIG. 1.

Figure 4:
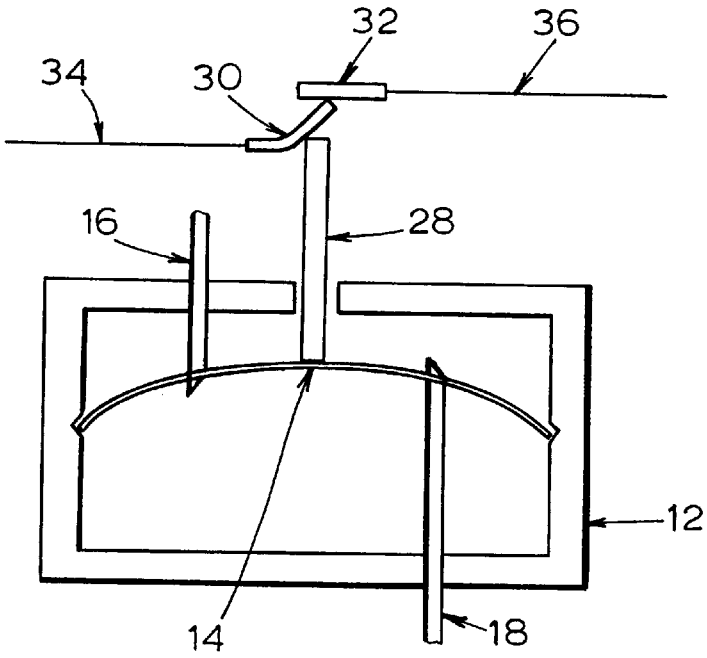
FIG. 4 shows the actuator of FIGS. 1–3 in a switching application wherein the actuator utilizes a plunger to force a cantilever into contact with a terminal.

The present invention can be used to actuate a variety of switches and devices well known to those skilled in the art. FIG. 4 depicts one embodiment of the present invention actuating a switch. A plunger 28 is connected to the apex of the leaf spring 14. In a preferred embodiment, the plunger 28 is comprised of a plastic rod. Of course, the plunger can be constructed out of a wide variety of materials and shapes. In one embodiment, the plunger 28 extends through a hole in the housing 12. When the leaf spring 14 is latched into the 'up' position, the plunger 28 pushes against a metal cantilever arm 30. The cantilever 30 flexes and makes electrical contact with a metal terminal 32. A first wire 34 is connected to the cantilever 30 and a second wire 36 is connected to the terminal 32. The electrical contact between the cantilever 30 and the terminal 32 acts as a switch and closes the circuit between the first and second wires 34, 36.

Figure 5:
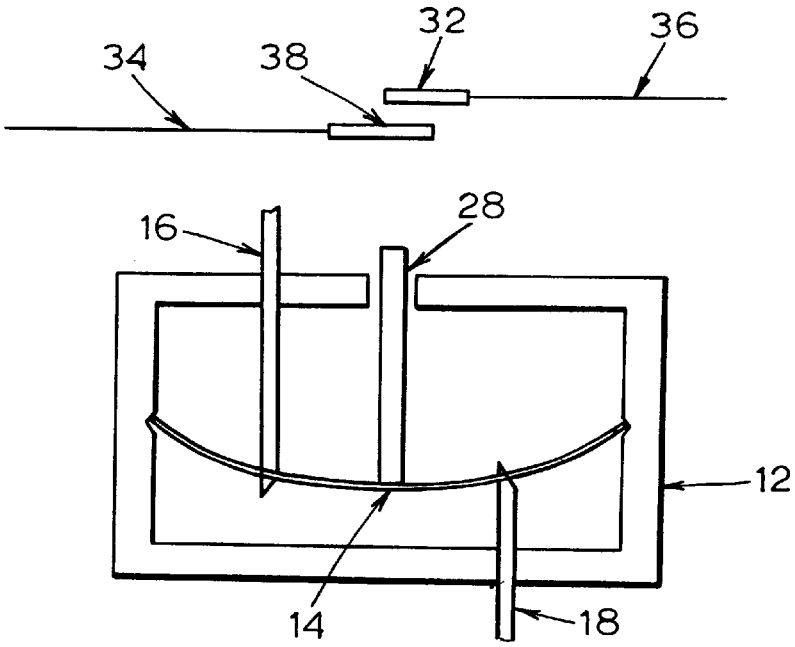
FIG. 5 shows the switching application of FIG. 4 wherein the actuator is positioned such that the circuit is open.

FIG. 5 depicts the same embodiment as FIG. 4. In FIG. 5, the leaf spring 14 is latched in the 'down' position. This lowers the plunger 28. With the leaf spring 14 in the 'down' position, the plastic plunger 28 does not push the cantilever 30 into the terminal 32 and the electrical connection between the first wire 34 and the second wire 36 is broken.

Figure 6:
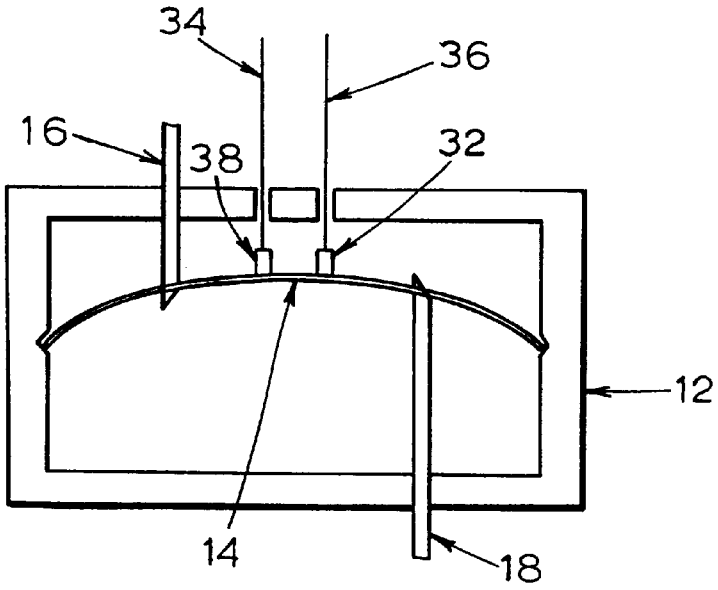
FIG. 6 shows the actuator of FIGS. 1–3 in a second switching application wherein the actuator is completing an electrical connection between two terminals with a conductive section of the leaf spring.
Figure 7:
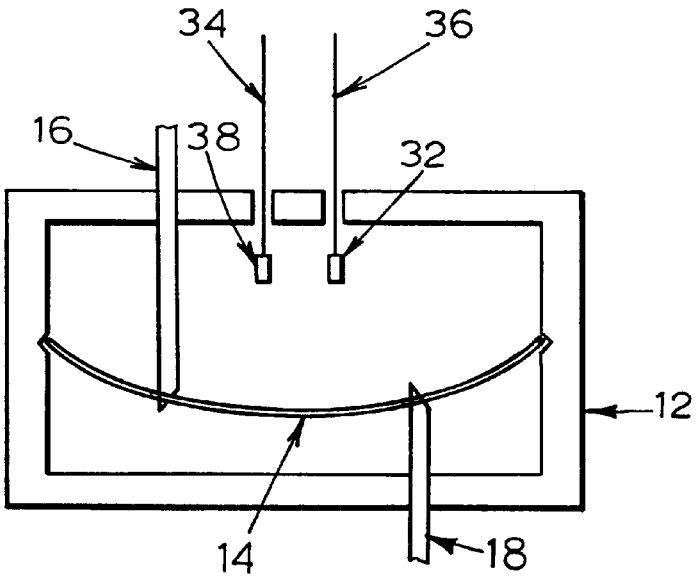
FIG. 7 shows the switching application of FIG. 6 wherein the actuator is positioned so that the circuit is open.

FIG. 6 and FIG. 7 depict an alternative switch configuration for an actuator embodying the present invention. In this embodiment, either the entire leaf spring 14 or at least the apex portion of the leaf spring 14 is electrically conductive. The first terminal 32 and a second terminal 38 enter the actuator through the housing 12. In FIG. 6, the leaf spring 14 is latched in the 'up' position. In the 'up' position, the conductive apex of leaf spring 14 makes contact with the first terminal 32 and the second terminal 38, electrically connecting the two terminals. This completes an electrical circuit between the first wire 34 and the second wire 36.

In FIG. 7, the leaf spring 14 has latched in the 'down' position. This removes the electrical connection between the first terminal 32 and the second terminal 38 and opens the circuit.

As will be apparent to those skilled in the art, there are many different switches and devices that can be designed using the present actuator. These switches and devices are well-known in the art, and the combination of those switches and devices with the present actuator should not take away from the present invention. It is therefore intended that the foregoing detailed description be regarded as illustrative rather than limiting and that it be understood that it is the following claims, including all equivalents, that are intended to define the scope of this invention.

What is claimed is:

1. An actuator comprising:

a) a housing;

b) a leaf spring having a first end connected to a first point on the housing and a second end connected to a second point on the housing;

c) a first shape-memory wire comprising a thermally reactive material that contracts when heated, said first wire positioned within the housing such that the first wire will contact the leaf spring when contracting, thereby directing the leaf spring into a first latching position, said first wire positioned within the housing such that the leaf spring will remain in said first latching position when said first wire returns to a first uncontracted length; and d) a second shape-memory wire comprising a thermally reactive material that contracts when heated, said second wire positioned within the housing such that the second wire will contact the leaf spring when contracting, thereby directing the leaf spring into a second latching position, said second wire positioned within the housing such that the leaf spring will remain in said second latching position when said second wire returns to a second uncontracted length.

2. The actuator of claim 1, wherein a) said leaf spring is positioned such that the leaf spring may latch in either the first latching position or the second latching position, said leaf spring remaining latched in the first latching position until the second wire contracts, said leaf spring remaining latched in the second latching position until the first wire contracts.

3. The actuator of claim 2, wherein a) said first wire includes an electrical resistance sufficient to cause said first wire to heat and contract when an electric current is passed through the first wire; and b) said second wire includes an electrical resistance sufficient to cause said second wire to heat and contract when an electric current is passed through the second wire.

4. The actuator of claim 3, further comprising a) a cantilever arm;

b) an electrical terminal; and c) a plunger attached to the leaf spring, said plunger of a length such that the plunger will contact and direct the cantilever arm into the electrical terminal when the leaf spring is in the first latching position, thereby electrically connecting the cantilever arm to the electrical terminal, and said plunger also being of a length such that the plunger will not contact the cantilever arm when the leaf spring is in the second latching position, thereby causing the cantilever arm and the electrical terminal to be electrically disconnected.

5. The actuator of claim 3, further comprising a) a first electrical terminal; and b) a second electrical terminal; wherein c) said leaf spring further comprising an electrically conductive surface on a portion of the leaf spring, said conductive surface located on the leaf spring such that the conductive surface will make an electrical connection between the first terminal and the second terminal when the leaf spring is in the first latching position, and said conductive surface further positioned on the leaf spring such that the conductive surface will not contact or electrically connect the first terminal and the second terminal when the leaf spring is in the second latching position.

6. A method of actuating a leaf spring, comprising:

a) heating a first thermally sensitive shape-memory wire such that a first force generated by the contracting said wire directs a leaf spring into a first latching position;

b) cooling the first thermally sensitive shape-memory wise to return the first thermally sensitive shape-memory wire to an uncontracted length without changing the first latching position of the leaf spring;

c) heating a second thermally sensitive shape-memory wire such that a second force generated by the contracting second wire directs the leaf spring into a second latching position; and (d) cooling the second thermally sensitive shape-memory wire to return the second thermally sensitive shape-memory wire to an uncontracted length without changing the second latching position of the leaf spring.

7. The method of claim 6, further comprising the steps of a) latching said leaf spring into the first latching position until the second wire is contracted; and b) latching said leaf spring into the second latching position until the first wire is contracted.

8. The method of claim 7, said method further comprising the step of a) heating said first wire and said second wire by passing an electric current through said wires.

9. The method of claim 8, further comprising the steps of a) raising a plunger by moving said leaf spring to the first latching position;

b) lowering said plunger by moving the leaf spring to the second latching position; and c) pressing a cantilever arm into electrical contact with an electrical terminal by raising said plunger into said cantilever arm.

10. The method of claim 8, further comprising the step of a) electrically connecting a first terminal to a second terminal by positioning said leaf spring into the first latching position, such that an electrically conductive surface of said leaf spring will contact the first terminal and the second terminal; and b) removing the electrical connection between said first terminal and said second terminal by positioning said leaf spring in the second latching position.

* * * * *